United States Patent [19]

Goldsmith et al.

[11] 4,275,630

[45] Jun. 30, 1981

[54] APPARATUS FOR SEPARATING RIBBON CABLE

[75] Inventors: Arthur C. Goldsmith, LaFayette; James P. Kirkgasser, DeWitt, both of N.Y.

[73] Assignee: K-G Devices Corporation, Dewitt, N.Y.

[21] Appl. No.: 106,846

[22] Filed: Dec. 26, 1979

[51] Int. Cl.[3] ..... B26D 1/24; B26D 3/12

[52] U.S. Cl. ..... 83/500; 81/9.51; 83/332; 83/664; 83/675

[58] Field of Search ..... 83/500, 664, 675, 665, 83/332; 225/97, 99; 81/9.51

[56] References Cited

U.S. PATENT DOCUMENTS

| | | | |
|---|---|---|---|
| 1,139,355 | 5/1915 | Feeley | 83/664 X |
| 1,939,246 | 12/1933 | Antonsen | 83/664 X |
| 3,172,326 | 3/1965 | Hamilton | 83/665 |
| 3,575,329 | 4/1971 | Hannabery | 83/500 X |
| 3,771,398 | 11/1973 | Schaefer et al. | 83/500 X |

*Primary Examiner*—Frank T. Yost

*Attorney, Agent, or Firm*—James Magee, Jr.

[57] ABSTRACT

An apparatus for separating conductors of a ribbon cable comprising a pair of fixed rollers having a plurality of radial intermeshing teeth spaced to engage the conductors.

4 Claims, 8 Drawing Figures

APPARATUS FOR SEPARATING RIBBON CABLE

The present invention relates to flat ribbon cable and a device for separating individual conductors of a ribbon cable without removal of the insulating covering of the conductors.

Ribbon cable consists of a plurality of individual insulated conductors arranged side-by-side in parallel in a single plane with a web of insulating material joining adjacent conductors. In use, it is necessary to disconnect and separate selected sections of adjacent conductors without removing any of the insulating material so that the conductors can be separately connected to different electrical circuits or terminals. Separation of the adjacent conductors by hand is a tedious and time consuming task which involves substantial risk of damage to the insulative covering material either by tearing or by inadvertent cutting with the blade used to cut the web.

The prior art devices are exemplified by the device of U.S. Pat. No. 3,575,329 to Hannabery.

The principal object of the present invention is to provide an apparatus for disconnecting and separating adjacent conductors of a flat ribbon type electrical cable.

Another object of the invention is to provide a conveniently operated device which can accept ribbon cable of varying width, cut the web between adjacent conductors, separate the conductors, and release the cable for withdrawal from the device.

A further object of the invention is to provide for separation of adjacent conductors of a ribbon cable without damage to, or removal of, the insulative covering of the individual conductors.

SUMMARY OF THE INVENTION

Briefly, this invention comprises a pair of fixed rollers of generally circular cross-section having a plurality of radial annular stepped intermeshing teeth spaced to engage and receive adjacent conductors of the ribbon cable with one of the rollers, i.e., set of stepped teeth, having a flattened peripheral portion adapted to receive within the nip of the rollers, the ribbon cable. The teeth-carrying rollers are spacially fixed to provide the necessary extent of intermesh or penetration to effect separation. The individual teeth are provided with a concave outer end, the curvature of which is substantially equal to the curvature of the outer surface of the conductors and in spaced parallel relationship so that the teeth of one roller are aligned with the space between the teeth of the other roller, thus achieving intermeshing.

The rollers are operated by a suitable gear and crank arrangement, thus feeding the cable in and out of the bight and separating the conductors.

The term "rollers" or "roller," as used herein, is intended to include the arrangement of individual stepped disk segments which can be arranged on a shaft for engaging the conductors of the ribbon cable. The number of conductors which can be separated can be varied by varying the number of disks. Of course the rollers can also be machined from an integral body to provide the cutting teeth which have an undercut side. It is preferable, however, to manufacture the stepped disks which can then be assembled on a shaft to provide the roller assembly.

The disk assembly technique also provides some flexibility with respect to separating only selected conductors, leaving others joined through the use of blank disks, i.e., without cutting teeth, interspersed with the standard cutting disk.

BRIEF DESCRIPTION OF THE DRAWINGS

The instant invention will be more clearly understood when considered in view of the accompanying drawings which illustrate a preferred embodiment of the invention.

DESCRIPTION OF THE PREFERRED EMBODIMENT

Figure 1:
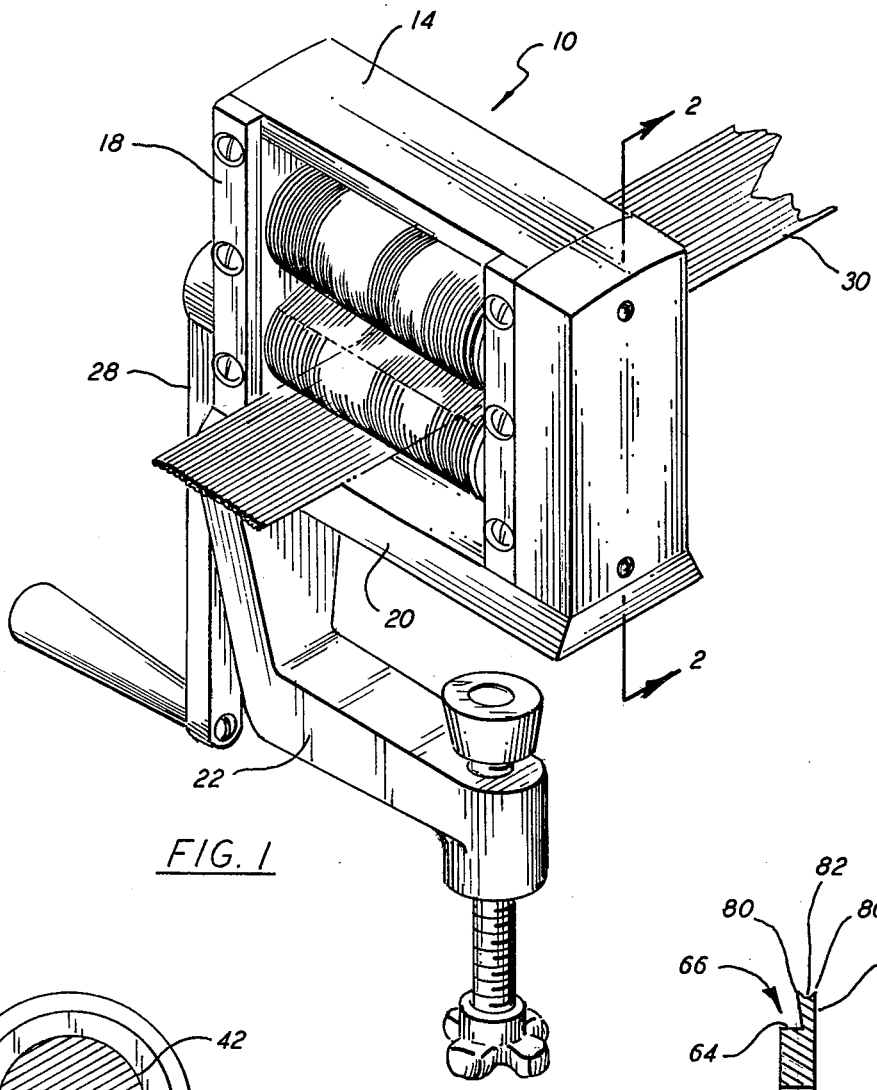
FIG. 1 is a perspective view of the apparatus of the invention.

Referring now to the drawings, and particularly to FIG. 1, the separator device 10 comprises a generally open centered rectangular body 12, having top 14, sides 16 and 18 and bottom 20. Bench clamp 22 is provided for mounting the apparatus on a table or work bench. Carried within the rectangular body 12 are upper and lower rollers 24 and 26 respectively. Lower roller 26 is operatively associated with crank handle 28. Ribbon cable 30 is shown in position. As illustrated, roller 26 is provided with a flat portion 32.

Figure 2:
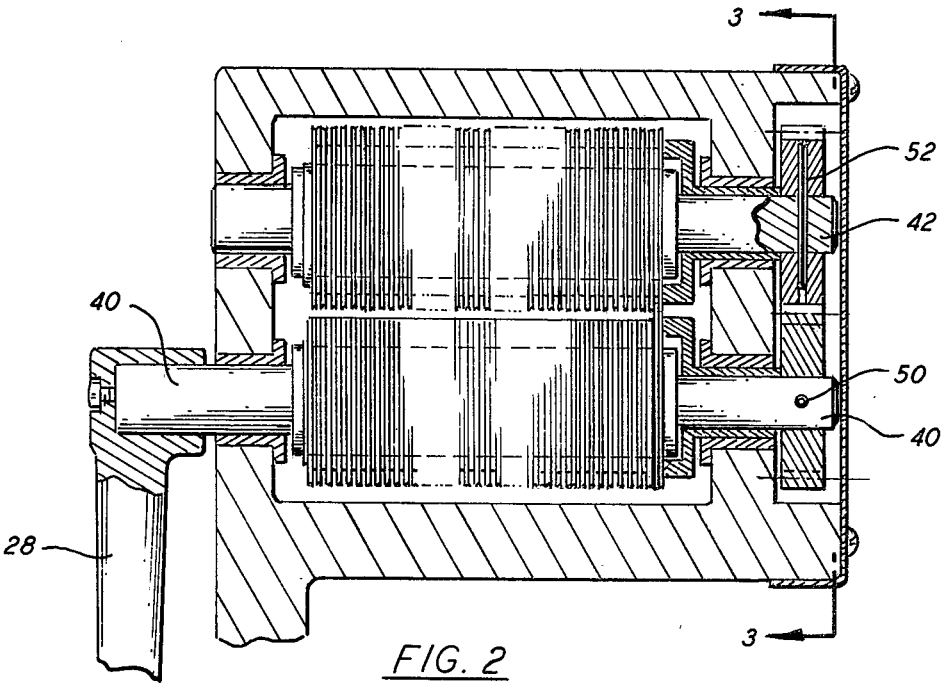
FIG. 2 is a sectional view taken along line 2—2 of FIG. 1.
Figure 3:
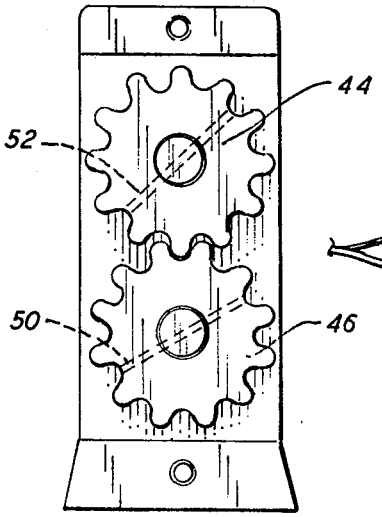
FIG. 3 is a plan view of the gears along line 3—3 of FIG. 2.
Figure 7:
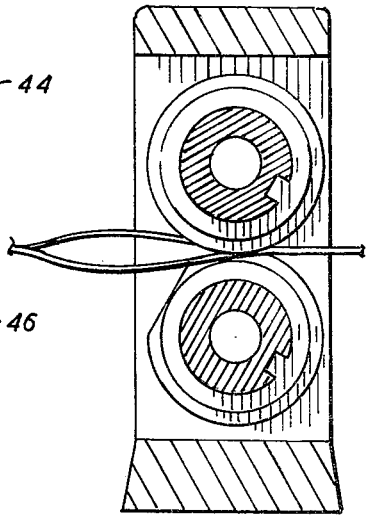
FIG. 7 is another enlarged sectional view of rollers and teeth showing the flattened portion of the lower roller and the position of the ribbon cable.

Rollers 24 and 26 are placed in a fixed relationship to each other within body 12 as can be seen in FIG. 2. The rollers, as shown, consist of a plurality of stepped disks arranged on a shaft. The shaft 40 of lower roller 26 is connected to crank 28. Both upper shaft 42 and lower shaft 40 are provided with gears 44 and 46 respectively so that operation of crank 28 will cause both rollers to turn. As shown, the gears are secured to the respective slotted shafts by pins 50 and 52. It is apparent that other power transfer mechanisms could be used to turn the rollers.

Figure 4:
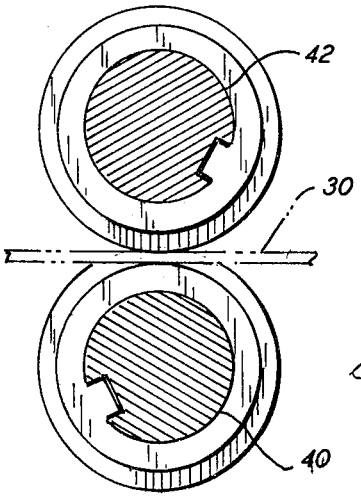
FIG. 4 is an enlarged sectional view of rollers and teeth showing the flattened portion of the lower roller and, in phantom, the position of the ribbon cable.
Figure 5:
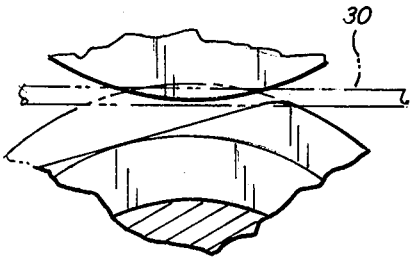
FIG. 5 is an enlarged sectional view of the flat portion of the lower roller showing the radius of curvature of the cutting edges.
Figure 6:
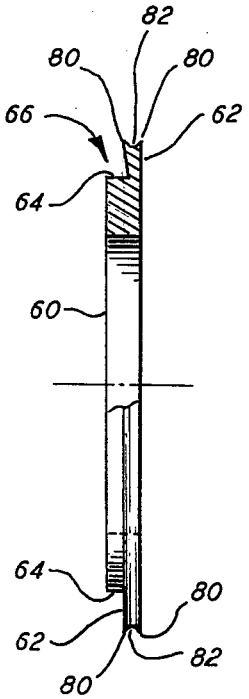
FIG. 6 is an end view, partially in section, of one of the cutting disks showing the undercut configuration of the cutting and separating tooth.
Figure 8:
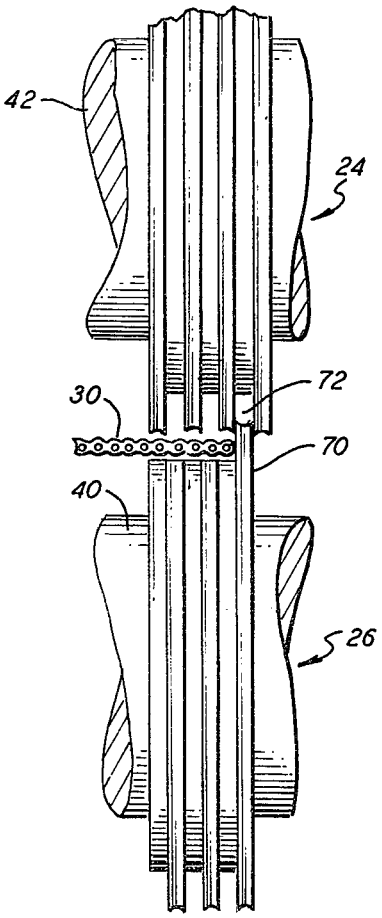
FIG. 8 is an enlarged end view of the cutting disks on the rollers with the ribbon cable positioned in the gap created by the flattened portion of the lower roller.

The stepped disks which are arranged to form the rollers and which provide the cutting and separating action of the device are illustrated in FIGS. 4, 6, and 8. Each disk consists of an annular body portion 60 keyed to fit onto the slotted shafts, an annular shoulder 64 radially extending concave cutter tooth portions 62 which, as shown at 66, are slightly undercut to reduce binding or wedging of the cable. It is apparent that by arranging the disks in sequence as seen in FIG. 8 alternate cutters 62 and shoulders 64 are provided.

Each cutter tooth 62 has a pair of sharp cutting edges 80 with the concave surface 82 therebetween. As the edges 80 cut the web between adjacent conductors, surface 82 forces the conductor down or up as the case may be into the corresponding space between adjacent teeth in the other roller.

In operation, for the separation of individual conductors of a flat ribbon-type electrical cable, the flat area of lower roller 26 is positioned in proximate engagement to the upper roller 24 forming an enlarged nip, and the end of the ribbon is placed in the nip of the rollers which are then rotated so that alternating upper and lower teeth contact adjacent conductors. Operation of crank 28 turns the lower roller 26, which in turn rotates upper roller 24 by means of gears 44 and 46. As the ribbon advances, the cutting edges of the teeth cut the web between conductors and force the conductor into the adjacent space thus separating the individual conductors.

The undercut area 66 of the cutter is an important feature of the apparatus of this invention since it cooperates with the cutter and spaces therebetween to facilitate operation of the apparatus, particularly withdrawal of the ribbon. Indeed, because the undercut portion eliminates binding of the conductor in the space between cutters, less force is needed to advance the ribbon. It also permits the operator to draw the separated ribbon back out of the roller without reverse cranking of the rollers.

It will be apparent that the apparatus of this invention is characterized by certain features not found, individually or in combination in the previously known cutting and separating devices, e.g., upper and lower rollers in fixed relationship, rollers consisting of a plurality of stepped disks, one or more rollers having a flat or truncated circumference portion, and cutting teeth having an undercut sidewall.

Accordingly, the apparatus of this invention consists of a first cylinderical roller having a plurality of radially extending annular teeth with a concave outer end and a second roller of truncated cylinderical configuration having corresponding radially extending annular teeth positioned to mesh with the teeth of said first roller, said rollers rotating on fixed axes. In highly preferred embodiments, the rollers comprise a plurality of cutting teeth having an undercut sidewall to provide a groove between teeth which is larger at the bottom than at the top.

In another highly preferred embodiment, the rollers comprise a plurality of stepped disks, with the undercut feature referred to above, mounted on rotatable shafts adapted for reciprocal rotation.

We claim:

1. An apparatus for separating individual conductors of a multi-conductor ribbon type electrical cable comprising in combination first and second roller members in fixed parallel relation to each other, each having a plurality of parallel annular teeth having concave outer ends and at least one undercut sidewall, spacing between adjacent teeth being at least as great as the width of the teeth, the teeth on one roller being aligned with the spaces between the teeth on the other and at least one of said rollers having a truncated portion and means for reciprocal rotation of said rollers.

2. The apparatus of claim 1 further comprising gear means mounted on said first and second roller members for simultaneous rotation.

3. The apparatus of claim 2 further comprising crank means operatively connected to at least one of said rollers.

4. The apparatus of claim 3 wherein the rollers comprise a plurality of stepped discs mounted on a shaft.

* * * * *